US007934638B2

(12) United States Patent
Lee

(10) Patent No.: US 7,934,638 B2
(45) Date of Patent: May 3, 2011

(54) GOLF COUNTER

(75) Inventor: Lien-Hsin Lee, Luchou (TW)

(73) Assignee: Moldtek Precision Corp., Taipei Hsien (TW)

( * ) Notice: Subject to any disclaimer, the term of this patent is extended or adjusted under 35 U.S.C. 154(b) by 382 days.

(21) Appl. No.: 12/164,112

(22) Filed: Jun. 30, 2008

(65) Prior Publication Data

US 2009/0321509 A1 Dec. 31, 2009

(51) Int. Cl.
*G06M 1/06* (2006.01)
*G06F 9/00* (2006.01)

(52) U.S. Cl. ..... 235/103; 116/309

(58) Field of Classification Search ..... 235/108, 235/113, 114, 103; 116/309
See application file for complete search history.

(56) References Cited

U.S. PATENT DOCUMENTS

| | | | | |
|---|---|---|---|---|
| 687,338 | A * | 11/1901 | Rockwell | 235/114 |
| 4,817,956 | A * | 4/1989 | Fogliani | 273/246 |
| 5,577,335 | A * | 11/1996 | Tucker | 40/311 |
| 6,779,480 | B2 * | 8/2004 | Zamjahn | 116/308 |
| 2003/0066874 | A1 * | 4/2003 | Davignon, II | 235/108 |
| 2009/0025625 | A1 * | 1/2009 | Lee | 116/223 |

* cited by examiner

*Primary Examiner* — Jamara A Franklin

(57) ABSTRACT

A golf counter includes a disk-like body member, which has a center opening, a series of symbols marked on the top wall and equiangularly spaced around the center opening, and a plurality of positioning holes corresponding to the symbols, a magnet secured to the bottom side of the disk-like body member, and a rotating faceplate, which is rotatably secured to the disk-like body member by the magnetic attraction force of the magnet and has a through viewing hole for showing one of the symbols of the disk-like body member, and two raised portions protruding from the bottom side and selectively engaging the positioning holes of disk-like body member to let the through viewing hole show one of the symbols.

11 Claims, 7 Drawing Sheets

GOLF COUNTER

BACKGROUND OF THE INVENTION

1. Field of the Invention

The present invention relates to a golf counter for counting the strokes during a golf game and more particularly, to such a golf counter, which comprises a rotating faceplate secured to a base by means of magnetic attraction and rotatable relative to the base to show one of a series of symbols (numerals) marked on the base.

2. Description of the Related Art

Most golf courses consist of eighteen holes. During a golf contest, every player performs one round of 18-hole as one cycle. These eighteen holes spaced from one another at a different distance. People usually play golf in groups. Each player records the score on a score card with a pen. Therefore, people usually carry a score card and a pen in the pocket for recording the score after a performance. It is inconvenient to record the scoe in this manner. Further, a beginner may forget the number strokes actually played, raising a dispute. An electronic scorer with push button may be used for counting strokes during a golf game. However, an electronic scorer is heavy and big. It is inconvenient to use an electronic scorer with push button during a golf game.

There are commercial rotory golf counters for counting the strokes by means of rotating a face member. However, these commerical rotary golf counters commonly have a complicated structure, not suitable for automatic production. There are known simple designs of rotary golf counters. However, these simple designs of rotary golf counters have the drawback of inaccurate positioning.

Therefore, it is desirable to provide a golf counter that eliminates the drawbacks of conventional designs.

SUMMARY OF THE INVENTION

The present invention has been accomplished under the circumstances in view. It is one object of the present invention to provide a golf counter, which has small thickness and high strength characteristics. It is another object of the present invention to provide a golf counter, which is suitable for mass production to reduce the cost.

To achieve these and other objects of the present invention, the golf counter is comprised of a base formed of a disk-like body member and a magnet, and a rotating faceplate. The disk-like body has a center opening, a series of symbols marked on the top wall and equiangularly spaced around the center opening, and a plurality of positioning holes corresponding to the symbols. The magnet is secured to the bottom side of the disk-like body member. The rotating faceplate is rotatably secured to the disk-like body member by the magnetic attraction force of the magnet, having a through viewing hole for showing one of the symbols of the disk-like body member and two raised portions protruding from the bottom side and selectively engaging the positioning holes of disk-like body member to let the through viewing hole show one of the symbols.

Further, an ornamental plate is fastened to the bottom side of the magnet opposite to the disk-like body member and the rotating faceplate, carrying a design. The design carried on the ornamental plate can be a company's logo or trademark, a graphic device, or a product blur.

DETAILED DESCRIPTION OF THE PREFERRED EMBODIMENT

Figure 1:
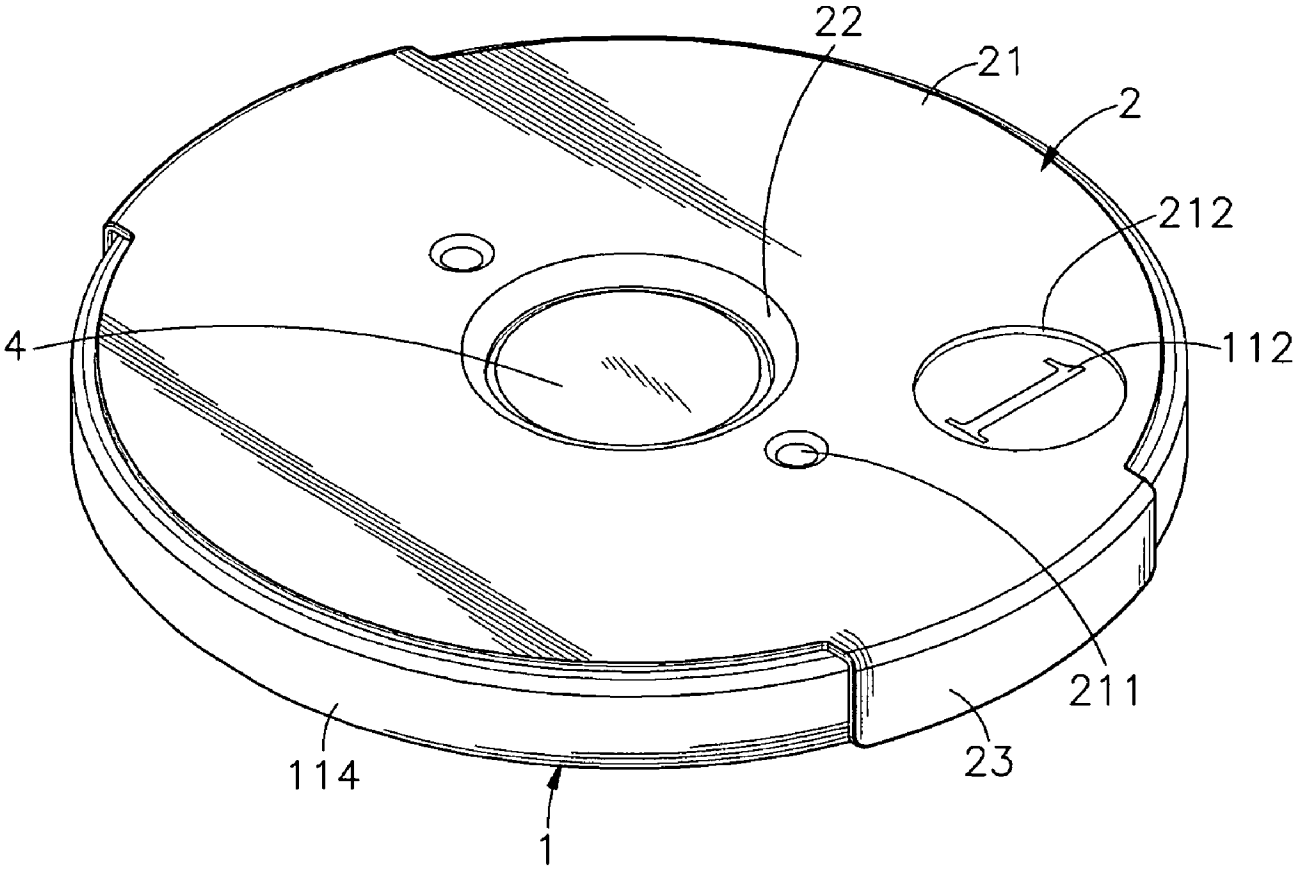
FIG. 1 is an oblique top elevation of a golf counter in accordance with the present invention.
Figure 2:
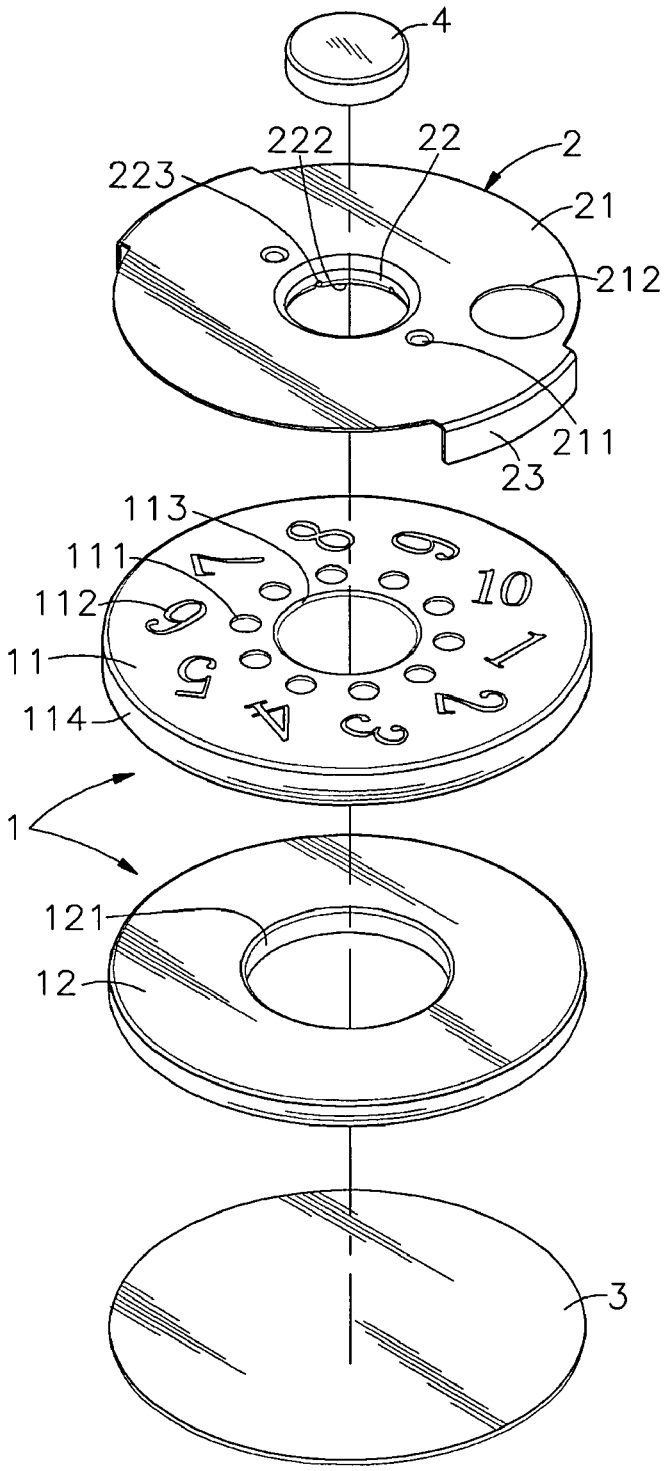
FIG. 2 is an exploded view of the golf counter in accordance with the present invention.
Figure 3:
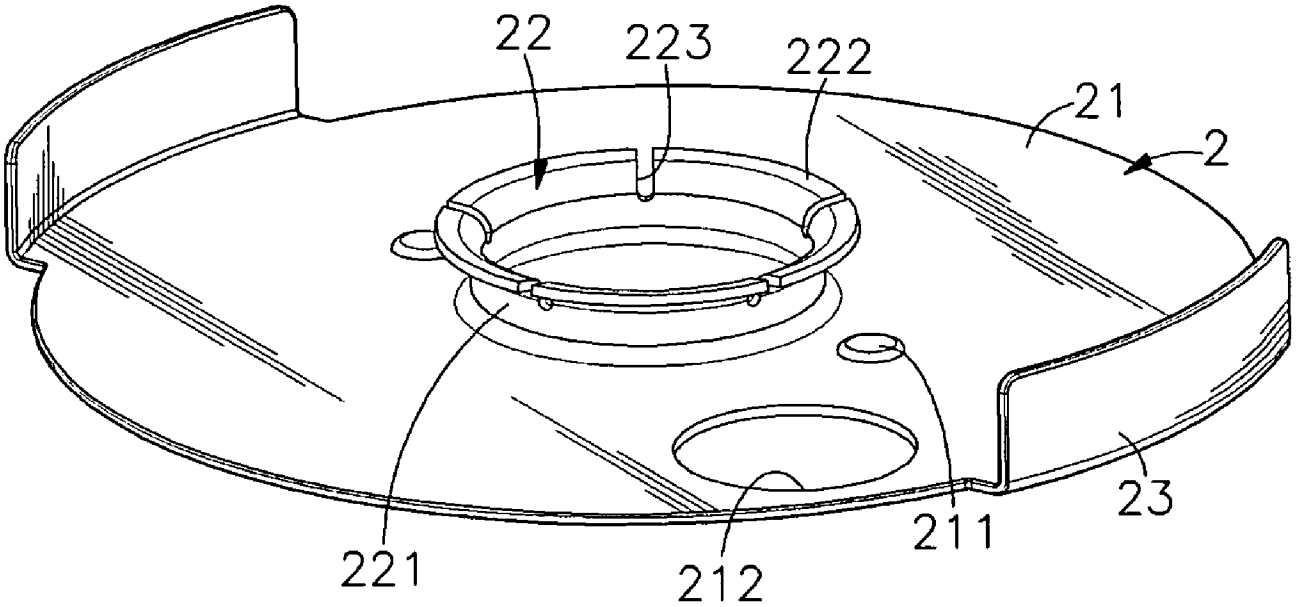
FIG. 3 is an oblique bottom elevation of the rotating faceplate of the golf counter according to the present invention.
Figure 4:
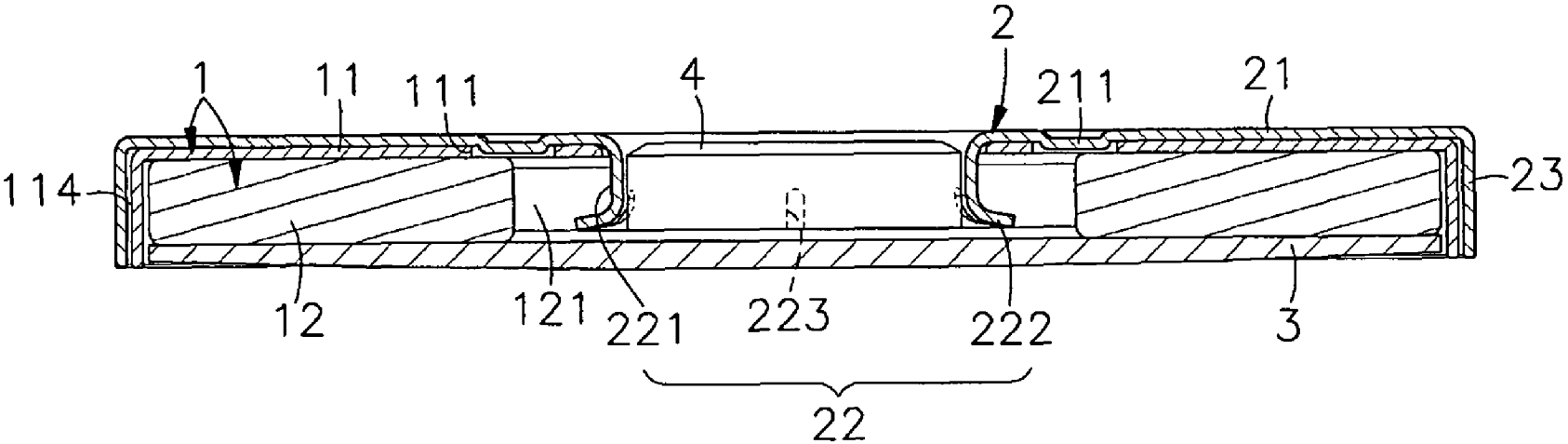
FIG. 4 is a cross-sectional view of the golf counter according to the present invention.

Referring to FIGS. 1~4, a golf counter in accordance with the present invention is shown comprised of a base 1 and a rotating faceplate 2.

The base 1 is comprised of a disk-like body member 11 and a magnet 12. The disk-like body member 11 has a center opening 113, a series of symbols (for example, a series of numerals from 1~10) 112 marked on the top wall thereof and equiangularly spaced around the circular center opening 113, a plurality of positioning holes 111 cut through the top and bottom walls and respectively disposed corresponding to the symbols 112, and a downward rim 114 extending around the periphery. The magnet 12 is press-fitted into the bottom side of the disk-like body member 11 secured within the downward rim 114, having a circular center opening 121. The circular center opening 121 of the magnet 12 has a diameter greater than the circular center opening 113 of the disk-like body member 11.

The rotating faceplate 2 is made of a magnetically attractive metal material (for example, steel or iron) and rotatably attached to the top side of the disk-like body member 11 of the base 1, having a hollow center coupling portion 22 coupled to the circular center opening 113 of the disk-like body member 11 and suspending in the circular center opening 121 of the magnet 12, two raised portions 211 protruded from the bottom wall and symmetrically disposed at two opposite sides relative to the center coupling portion 22 and selectively engaged into the positioning holes 111 of the disk-like body member 11, a through viewing hole 212 for showing one of the symbols 112 of the disk-like body member 11, and two smoothly arched finger strips 23 downwardly extending from the periphery at two opposite sides and respectively attached to the outer surface of the downward rim 114 of the disk-like body member 11. The center coupling portion 22 has a neck 221 inserted through the circular center opening 113 of the disk-like body member 11, an outward stop flange 222 extending from the free end of the neck 221 and stopped below the wall of the disk-like body member 11, and a plurality of crevices 223 axially cut through the outward stop flange 222. The axial length of the neck 221 is greater than the depth of the circular center opening 113 of the disk-like body member 11 so that the rotating faceplate 2 is horizontally rotatable relative to the base 1 and vertically movable relative to the base 1 within a limited range subject to the length of the neck 221 of the center coupling portion 22 of the rotating faceplate 2.

Further, the disk-like body member 11 can be made of steel, iron or any magnetically attractive metal material. Alternatively, the disk-like body member 11 can be molded from plastics. If the disk-like body member 11 is made of a magnetically attractive metal material, the disk-like body member 11 and the magnet 12 can be firmly secured together by means of magnetic attraction. If the disk-like body member 11 is molded from plastics, an adhesive can be used to bond the disk-like body member 11 and the magnet 12 together. When the rotating faceplate 2 is attached to the base 1, the raised portions 211 of the rotating faceplate 2 are respectively engaged into one respective positioning hole 111 of the disk-like body member 11, and a magnetic attraction force is produced between the rotating faceplate 2 and the base 1 to secure the rotating faceplate 2 in position.

Figure 5:
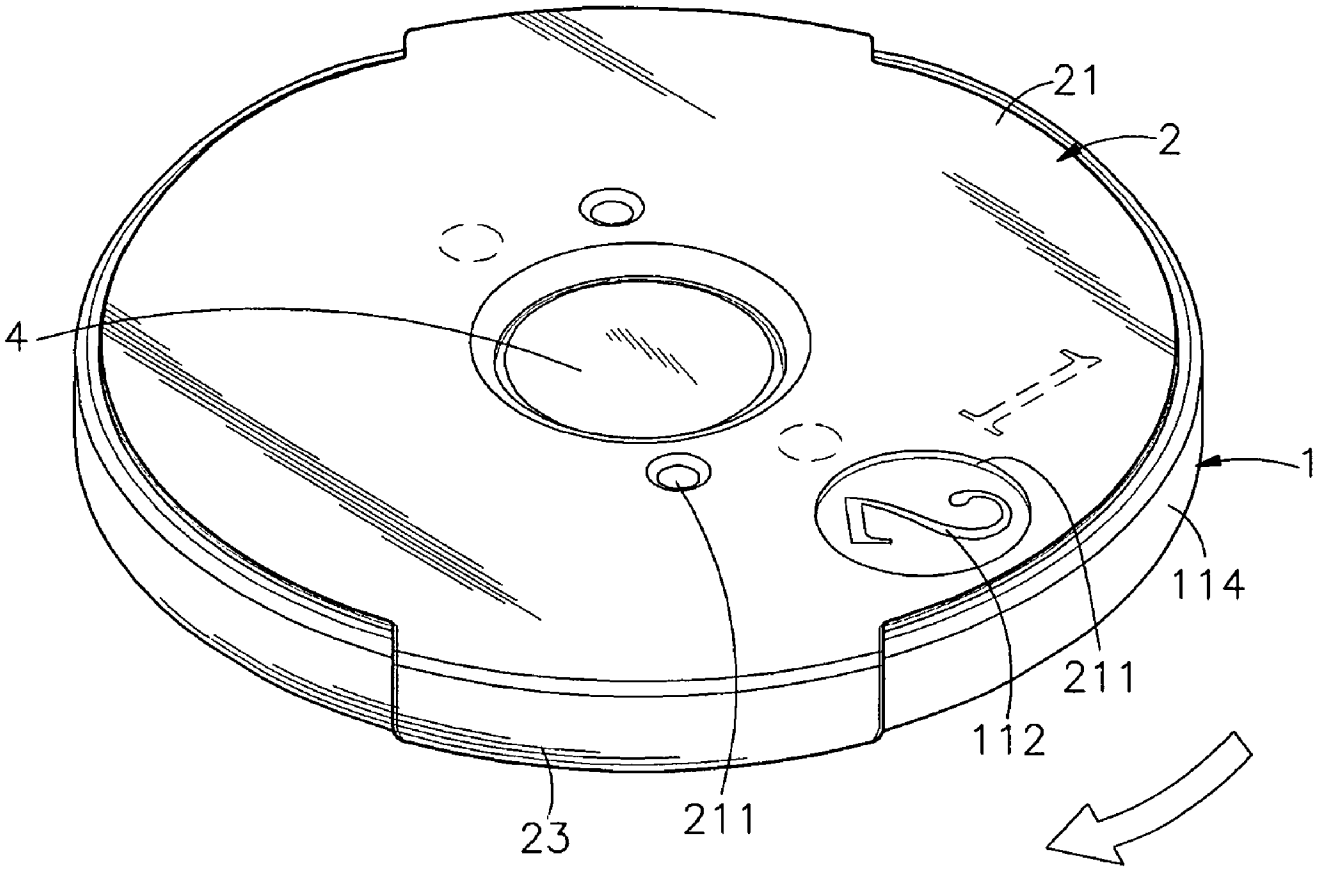
FIG. 5 is a schematic elevational view of the present invention, showing the rotating faceplate rotated relative to the base.
Figure 6:
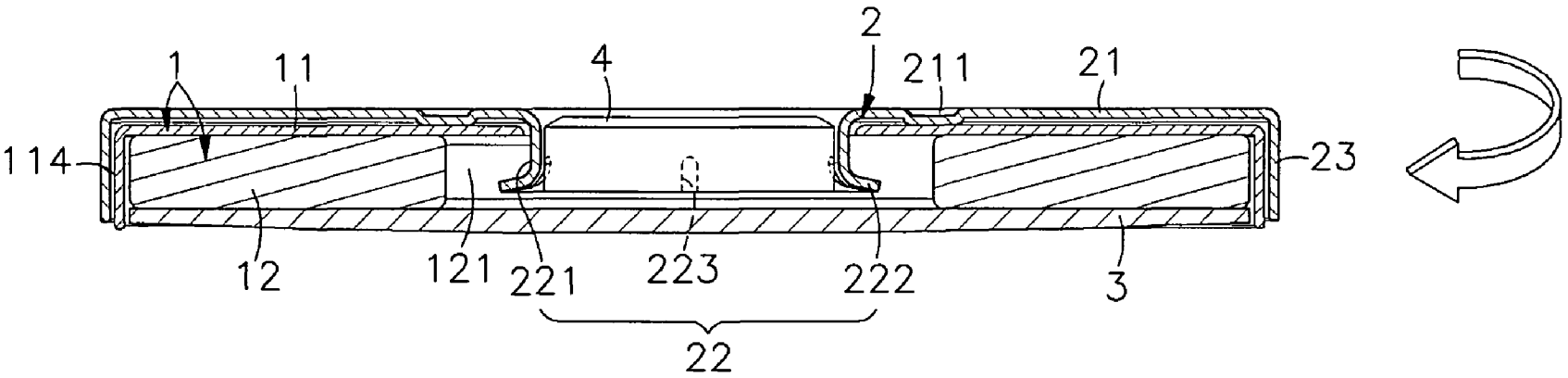
FIG. 6 is a schematic sectional view showing the operation of the present invention.

Referring to FIGS. 5 and 6 and FIG. 4 again, when rotating the rotating faceplate 2 relative to the base 1, the raised portions 211 are moved away from the positioning holes 111 of the disk-like body member 11 over the top wall, and the outward stop flange 222 of the rotating faceplate 2 is stopped at the bottom wall of the disk-like body member 11 to prohibit disconnection of the rotating faceplate 2 from the disk-like body member 11. When continuously rotating the rotating faceplate 2 relative to the base 1, each raised portion 211 will be shifted from one positioning hole 111 of the disk-like body member 11 to another. When each raised portion 211 is shifted from one positioning hole 111 of the disk-like body member 11 to another, a next one of the symbols 112 is seen through the through viewing hole 212 of the rotating faceplate 2. Therefore, a golfer can rotate the rotating faceplate 2 to count the number of strokes during a golf game.

Figure 7:
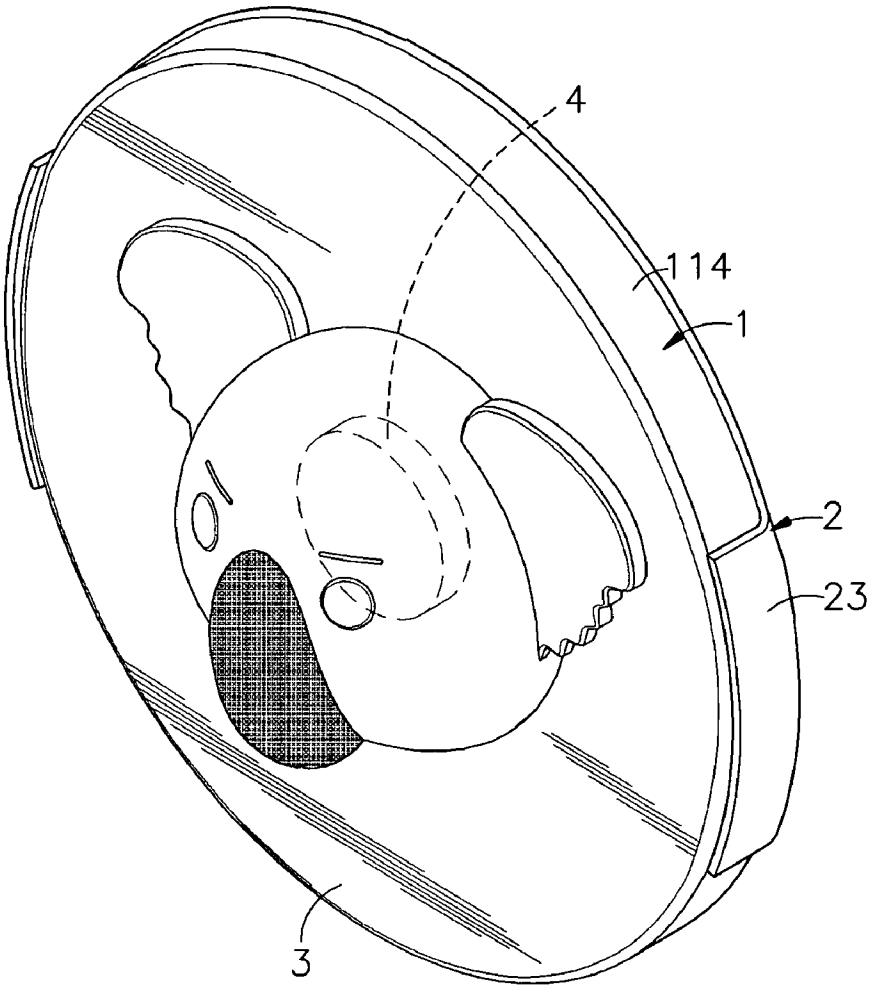
FIG. 7 is a perspective view of the present invention showing a different design of the ornamental plate of the golf counter.

Referring to FIG. 7 and FIG. 2 again, an ornamental plate 3 is fastened to the bottom side of the magnet 12 of the base 1. The ornamental plate 3 can be marked with a trademark, logo, or any commercial design. Further, a magnet 4 can be fastened to the hollow center coupling portion 22 of the rotating faceplate 2 for securing the golf counter to a magnetically attractive article.

Referring to FIGS. 2 and 4 again, as stated above, the rotating faceplate 2 has two downwardly protruding raised portions 211 for selectively engaging into positioning holes 111 of the disk-like body member 11 of the base 1 to assure positive positioning. However, the positioning arrangement between the rotating faceplate 2 and the disk-like body member 11 of the base 1 is not limited to this design. Any modifications may be made thereunto without departing from the spirit and scope of the invention.

Further, ribs or protrusions may be provided at the periphery of the rotating faceplate 2 to substitute for the aforesaid finger strips 23, allowing a user to rotate the rotating faceplate 2 conveniently with the fingers.

As indicated above, the invention provides a golf counter, which has the following features.

1. The golf counter is comprised of a disk-like body member 11, a magnet 12 and a rotating faceplate 2, suitable for mass production to lower the manufacturing cost. Further, the golf counter has a small thickness and high strength.

2. By means of magnetic attraction and engagement between the positioning holes 111 and raised portions 211, accidental displacement of the rotating faceplate 2 is prohibited.

3. The golf counter can be provided with an ornamental plate 3 carrying commerical design, such as a company's logo or trademark, and equipped with a magnet 4 for fastening to an article made of steel, iron or any magnetically attactive material.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A golf counter, comprising:

a base, said base comprising a disk body member and an annular magnet attached to a bottom side of said disk body member, said disk body member comprising a top wall, a bottom wall opposing said top wall, a center opening cut through said top wall and said bottom wall, a series of symbols marked on said top wall and equiangularly spaced around said center opening, and a plurality of female positioning means; and a rotating faceplate rotatably attached to the top wall of said disk body member and magnetically attractable to said annular magnet of said base, said rotating faceplate comprising a through viewing hole for showing one said symbol of said disk body member, and at least one male positioning means selectively engaging said female positioning means to let said through viewing hole show one said symbol.

2. The golf counter as claimed in claim 1, wherein said disk body member comprises a downward rim downwardly extending around the periphery thereof.

3. The golf counter as claimed in claim 1, wherein said female positioning means of said disk body member comprises a plurality of positioning holes cut through the top wall and bottom wall of said disk body member and respectively disposed corresponding to said symbols; said at least one male positioning means of said rotating faceplate comprises two raised portions protruded from a bottom wall thereof and symmetrically disposed at two opposite sides and selectively engaged into the positioning holes of said disk body member.

4. The golf counter as claimed in claim 1, wherein said rotating faceplate comprises at least one arched finger strip downwardly extending from the periphery thereof.

5. The golf counter as claimed in claim 1, wherein said rotating faceplate comprises a hollow center coupling portion rotatably coupled to the center opening of said disk body member.

6. The golf counter as claimed in claim 1, wherein said hollow center coupling portion of said rotating faceplate comprises a neck inserted through the center opening of said disk body member and an outward stop flange extending from a distal end of said neck and suspending below the bottom wall of said disk body member, said outward stop flange having a diameter greater than the diameter of said center opening of said disk body member.

7. The golf counter as claimed in claim 6, wherein said hollow center coupling portion of said rotating faceplate further comprises a plurality of crevices cut through said outward stop flange.

8. The golf counter as claimed in claim 1, further comprising an ornamental plate fastened to one side of said annular magnet opposite to said disk body member and said rotating faceplate.

9. The golf counter as claimed in claim 1, further comprising a second magnet embedded in the center of said rotating faceplate for fastening said golf counter to an external magnetically attractable device.

10. The golf counter as claimed in claim 1, wherein said rotating faceplate is made of steel.

11. The golf counter as claimed in claim 1, wherein said rotating faceplate is made of iron.

* * * * *